United States Patent [19]

Williams

[11] 3,965,330

[45] June 22, 1976

[54] THERMAL PRINTER HEAD USING RESISTOR HEATER ELEMENTS AS SWITCHING DEVICES

[75] Inventor: Kenneth S. Williams, Barrington, Ill.

[73] Assignee: Motorola, Inc., Schaumburg, Ill.

[22] Filed: Aug. 5, 1974

[21] Appl. No.: 494,145

[52] U.S. Cl. ..... 219/216; 219/543; 338/20; 338/307; 338/320

[51] Int. Cl.[2] ..... H05B 1/00

[58] Field of Search ..... 219/216, 388, 543; 346/76 R; 338/320, 20, 307

[56] References Cited

UNITED STATES PATENTS

| | | | |
|---|---|---|---|
| 3,323,241 | 6/1967 | Blair et al. | 219/543 X |
| 3,478,191 | 11/1969 | Johnson et al. | 219/543 X |
| 3,483,356 | 12/1969 | Kalt | 219/216 |
| 3,825,722 | 7/1974 | Taniguchi | 219/216 |
| 3,870,856 | 3/1975 | Taniguchi | 219/216 |

*Primary Examiner*—C. L. Albritton
*Attorney, Agent, or Firm*—Vincent J. Rauner; Victor Myer; Phillip Melamed

[57] ABSTRACT

A method and apparatus for a thermal printer head which uses individual heater elements as switching devices is disclosed. The printer head consists of an array of individual resistors each capable of causing a dot to print on thermally sensitive paper. The use of heater elements as switches reduces the total number of lead outs required for the printer head. A system that uses such a thermal printer head is also disclosed. The individual resistor heater elements have a voltage-current switching characteristic which enables them to be used as switching devices in addition to their function as heating elements.

17 Claims, 6 Drawing Figures

THERMAL PRINTER HEAD USING RESISTOR HEATER ELEMENTS AS SWITCHING DEVICES

BACKGROUND OF THE INVENTION

In known thermal printers, an array of heater elements on a substrate is held in contact with thermally sensitive paper. The individual heater elements are then selectively energized to form a desired array of dots on the thermally sensitive paper. Thereafter the paper is shifted and another desired array of dots is created on the paper. The process is continued and the dots on the thermal paper form individual letters and numbers, each individual character consisting of a group of dots.

Printer heads which use thick or thin film resistors on a ceramic substrate as heating elements for marking thermally sensitive paper are known in the art. The limitiations of such thermal printer heads are the need for an excessive number of lead out connections from the thermal printer head and/or the requirement for the use of isolation devices, such as diodes, either on the thermal printer head itself or in the peripheral circuitry. Isolation devices are required to prevent the energizing of undesired heating elements when individual heating elements are connected in a matrix in order to reduce the complexity of circuits that select which heating elements are to be energized.

Some thermal printer heads have been fabricated using mesa transistors instead of thick film resistors as the heating elements, and thus the semiconductor element itself serves as the heating device. These printer heads do eliminate the need for additional seimconductor devices for isolation, but the expense of mounting an array of individual semiconductor devices on a printer head far exceeds the expense of formulating a network of thick or thin film resistors on a ceramic substrate.

Resistors having a voltage-current switching characteristic are common and they are used either as voltage transient suppressors or as replacements for semiconductor switches. These resistors have not, however, been used as both heating and switching elements.

SUMMARY OF THE INVENTION

An object of this invention is to provide an improved thermal printer head that reduces the number of lead outs required in known resistor heater element printer heads.

Another object of this invention is to provide an improved thermal printer head which eliminates the need for additional isolation devices.

Still another object of this invention is to provide an improved method of using individual resistors having voltage-current switching characteristics as both heater elements and switching elements A further object of this invention is to provide an improved method for using individual resistors as both heater elements and switching elements in a thermal printer head, to eliminate additional isolation devices and reduce the number of lead outs.

An additional object of this invention is to provide an improved economical method of constructing a reliable thermal printer head.

In carrying out the invention according to one form, there is provided a thermal printing system comprising: thermal printer head means; a plurality of voltage-current switching characteristic resistors attached to said printer head means, each of said resistors having a threshold voltage; a plurality of first selector terminals; a plurality of second selector terminals; first means for connecting each of said first terminals through different paths, a different one of said plurality of resistors being included in each path, to each of said second terminals; and second means for applying a voltage greater than said threshold voltage between said first and second terminals to energize only selected predetermined individual resistors in said plurality of resistors.

The present specification discloses a thermal printer head used in a thermal printing system. The thermal printer head has resistor heating elements which are constructed such that the individual resistor heater elements have a voltage-current switching characteristic. The use of resistors having a voltage-current switching characteristic as individual heater elements results in the elimination of semiconductor devices which would normally be used for isolation purposes, and permits a reduction in the number of lead outs from the thermal printer head. The resistor heater elements can be formulated by using known thick film screening and firing techniques and commonly available thick film resistor compositions. A printer head using a one line resistor dot matrix is described, but the invention herein disclosed is not limited to such a matrix and can be used in any other resistor array.

Individual heating element resistors interconnected in an array are selectively energized by applying voltages greater than a threshold voltage across a desired resistor. Each heating element resistor has a threshold voltage-current switching characteristic.

BRIEF DESCRIPTION OF THE DRAWINGS

For a more complete understanding of the invention, reference should be made to the drawings in which.

DETAILED DESCRIPTION OF THE PREFERRED EMBODIMENT OF THE INVENTION

Figure 1:
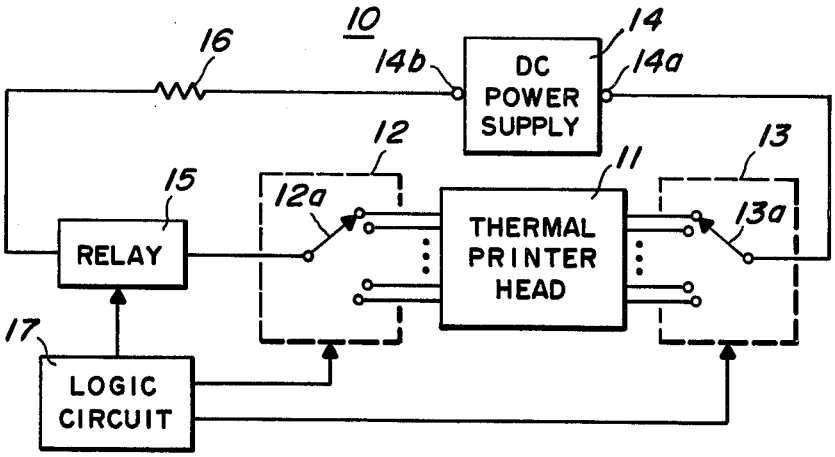
FIG. 1 is a block diagram of a thermal printing system using the inventive thermal printer head.

FIG. 1 shows the electrical connections of a known thermal printing system 10 which uses the inventive thermal printer head 11. In printing system 10, the thermal printer head 11 is in contact with thermally sensitive paper (not shown), and the electrical components shown in FIG. 1 generate voltages to activate individual heater elements on the thermal printer head, causing marks to appear on the thermally sensitive paper. Such systems which use prior art thermal printer heads are generally known.

The thermal printer head 11 has a plurality of first connections to a number of fixed terminals of a first selector circuit 12 (shown dotted), has a plurality of second connections to a number of fixed terminals of a second selector circuit 13 (also shown dotted), and has a plurality of internal resistor heater elements (not shown). Each resistor heater element internal to thermal printer 11 has a voltage-current switching characteristic which will be described more fully subsequently. Selector circuits 12 and 13 are each shown as single pole multiple position rotary switches with rotor arms 12A and 13A, respectively. Rotor arm 13A of selector circuit 13 is connected to a first terminal 14A of a DC power supply 14 which can be a battery, for example. An opposite polarity terminal 14B of DC power supply 14 is connected to a relay 15 through a current limiting resistor 16. The relay 15 is connected to rotor arm 12A of selector circuit 12. A logic circuit 17 is connected to relay 15, selector circuit 12 and selector circuit 13, and provides control signals to selector circuits 12 and 13, and to relay 15. Selector circuits 12 and 13 are shown as comprising simple rotary switches merely for clarity, electronic switching being contemplated. The logic circuit 17 develops control signals in response to an appropriate source, such as a multiplex system in a radio receiver (not shown) or the core memory of a computer (also not shown), and supplies them to relay 15 such that the selector circuit 12 either receives or does not receive a DC voltage from power supply 14. The logic circuit 17 also develops control signals, coupled to selector circuts 12 and 13, which sequentially step rotor arms 12A and 13A, or sequence electronic switches, so as to periodically connect each of the resistor heater elements inside thermal printer head 11 between relay 15 and DC power supply 14. As the entire matrix of resistor heater elements is stepped through by the sequence of control signals coupled to selector circuits 12 and 13, the logic circuit 17 supplies control signals to relay 15 to determine whether an individual resistor heater element is will be energized. When an individual resistor heater element is energized, a dot is created on the thermally sensitive paper which is in contact with the thermal printer head. After an entire sequence of control signals is completed, the thermally sensitive paper is then moved and a new sequence of signals corresponding to the next line to be printed is generated by logic circuit 17.

Figure 2:
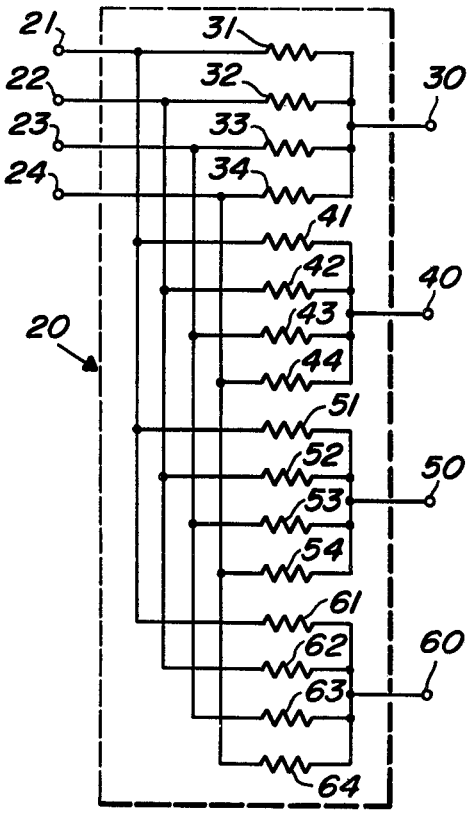
FIG. 2 is a circuit diagram of a thermal printer head according to the invention.

Referring to FIG. 2, there is shown a circuit diagram of a thermal printer head 20 which is a specific embodiment of the printer head 11 shown in FIG. 1 and includes a plurality of individual resistor heater elements, each of which has a voltage-current switching characteristic. The printer head 20 has eight external connections, one connection each to a terminal 21, 22, 23, 24, 30, 40, 50 and 60. Terminals 21, 22, 23 and 24 are termed dot selector terminals for convenience and terminals 30, 40, 50 and 60 are termed group selector terminals for convenience. The dot selector terminals correspond to the plurality of first selector terminals connected to selector switch 12 in FIG. 1 and the group selector terminals correspond to the plurality of second selector terminals connected to selector switch 13 in FIG. 1. Each of the dot selector terminals is connected to each of the group selector terminals through a different path, each path having one of the plurality of resistors and including only different resistors of said plurality of resistors. The terminal 21 is connected to terminal 30 through a resistor 31, to terminal 40 through a resistor 41, to terminal 50 through a resistor 51, and to terminal 60 through a resistor 61. The terminal 22 is connected to terminal 30 through a resistor 32, to terminal 40 through a resistor 42, to terminal 50 through a resistor 52, and to terminal 60 through a resistor 62. The terminal 23 is connected to terminal 30 through a resistor 33, to terminal 40 through a resistor 43, to terminal 50 through a resistor 53, and to terminal 60 through a resistor 63. The terminal 24 is connected to terminal 30 through a resistor 34, to terminal 40 through a resistor 44, to terminal 50 through a resistor 54, and to terminal 60 through a resistor 64. All resistors are approximately equal in value, function as resistor heater elements, and have a voltage-current switching characteristic. Although only sixteen resistors are shown in thermal printer head 20 and these are connected between four dot selector terminals 21, 22, 23, 24 and four group selector terminals 30, 40, 50, 60, it is understood that the invention is not limited to such an array but can be extended to a larger array consisting of any number of dot selector terminals and any number of group selector terminals similarly interconnected.

Figure 3:
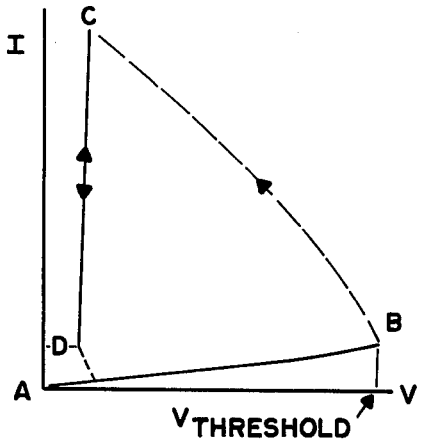
FIG. 3 is a graph illustrating a voltage-current switching characteristic suitable for individual resistor heater elements.
Figure 4:
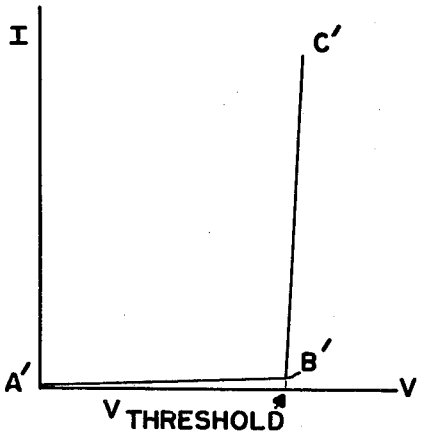
FIG. 4 is a graph illustrating another voltage-current switching characteristic suitable for individual resistor heater elements.

In thermal printer head 20 shown in FIG. 2, the individual resistor heater elements have voltage-current switching characteristics, such as those shown in FIGS. 3 and 4, for example. The essential characteristic of FIGS. 3 and 4 is that above some threshold voltage, the current greatly increases; or to put it another way, the resistance of the resistor greatly decreases.

FIG. 3 shows a resistor voltage-current switching characteristic which remains linear as the voltage is increased from zero volts (A) up to a threshold voltage (B). The slope of line segment AB is close to zero and therefore indicates a high value of resistance. When the threshold voltage (B) is exceeded, the resistance value undergoes a drastic change, and the characteristic shifts to a point (C), which represents a large current (limited by external circuitry) and a small voltage. Any decrease in voltage, now results in operation along line CD which has a large slope representing a low value of resistance. Whenever the current falls below point D, the resistor characteristic returns to operation along line AB. Resistors having the characteristic shown in FIG. 3, which is similar to the characteristic of a silicon controlled rectifier (SCR), can be made from thick film resistor materials such as Tyrox, manufactured by DuPont. Using Tyrox, resistance values typically change by a factor of 1000 when the threshold voltage is exceeded.

FIG. 4 shows a resistor voltage-current switching characteristic similar to the reverse characteristic of a zener diode. The resistance value remains high and constant as the voltage is increased from zero volts (A′) to the threshold voltage (B′). Above the threshold voltage the characteristic abruptly changes slope, indicating a much lower resistance as shown by line segment B′C′. Metal oxide varistors having this characteristic are sold by the General Electric Company and are made from a sintered resistor material.

Figure 5:
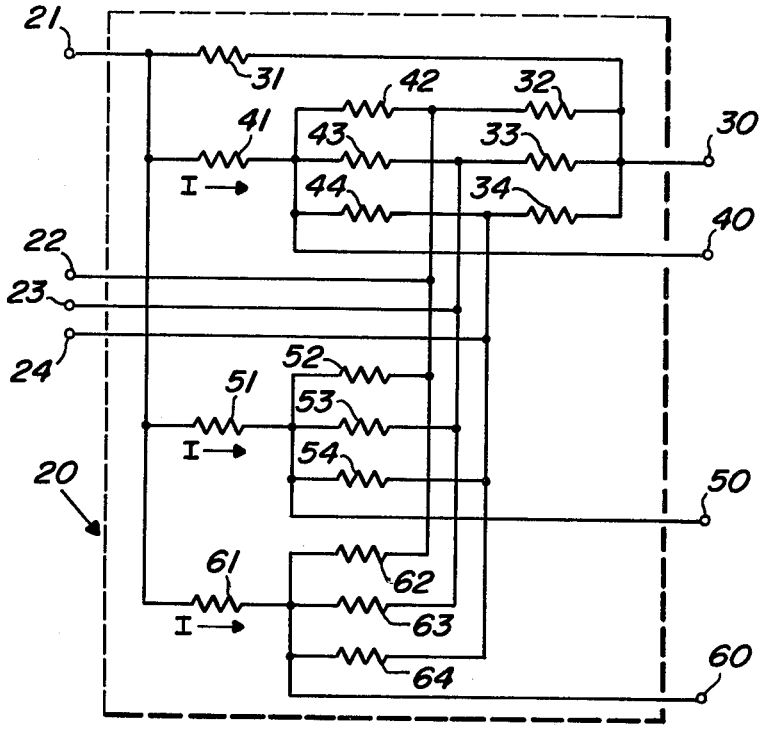
FIG. 5 is the circuit of FIG. 2 redrawn for easier analysis.

The advantage of using resistors having a voltage-current switching characteristic in thermal printer 20 can be shown by referring to FIG. 2 or FIG. 5 which is FIG. 2 redrawn to clearly show all the parallel resistor paths that exist between terminals 21 and 30. To energize the resistor element 31, a voltage is applied between terminals 21 and 30. While the entire voltage is applied across resistor 31, it is obvious that voltages exist across all other resistors shown in thermal printer 20, since every resistor is included in some parallel path between terminals 21 and 30. For example, resistors 41, 42 and 32 form one such parallel path. The voltage that exists across all other resistors in thermal printer head 20 is less than the voltage across resistor 31, since resistor 31 represents the only direct single resistor path between terminals 21 and 30. By virtue of this only the resistor 31 prints a dot as will become clear.

If the voltage applied across any resistor is below the threshold voltage, that resistor will not dissipate enough power to mark the thermally sensitive paper. The power dissipated in a resistor is $P = V^2/R$, where $V$ is the voltage applied and $R$ is the resistance of the resistor. If the voltage applied is just below the threshold voltage, $P \approx (V_{threshold})^2/R$; but if the voltage applied is just above the threshold voltage and the resistor is made from Tyox for example, $P \approx (V_{threshold})^2(1000)/R$. Therefore by applying a voltage greater than the threshold voltage, the power dissipation of a resistor heater element would be increased by a factor of 1000. Thus when a voltage greater than the threshold voltage is applied across terminals 21 and 30 only resistor 31 will be energized, draw a significant current and dissipate enough power to generate heat to mark the thermally sensitive paper, provided that the voltage across all other resistors is below the threshold voltage. The function of current limiting resistor 16 in FIG. 1 is now seen to be to limit the actual dissipation of the resistor heater elements after switching and so prevent burnout.

The exact ratio of the voltage applied across resistor 41 to the voltage applied across resistor 31 when a voltage is applied between terminals 21 and 30 can be calculated. In FIG. 5 if a DC voltage less than the threshold voltage is applied across terminals 21 and 30, a current I can be assumed flowing through resistor 41, therefore a current I is also flowing in resistors 51 and 61 by symmetry. The current flowing through resistor 41 divides into three equal currents which flow through resistors 42, 43 and 44 respectively. The currents flowing through resistors 51 and 61 likewise equally divide into thirds between resistors 52, 53 and 54 and 62, 63 and 64 respectively. The current flowing through resistor 32 is equal to I, since it is the sum of the currents flowing in resistors 42, 52 and 62; and the current flowing through resistors 33 and 34 is also equal to I. If all the resistors are considered to be equal in value, the ratio of the voltage across resistor 31 to the voltage across resistor 41 can be shown to be 7/3 by summing the voltage drops across resistors 41, 42 and 32. Thus no other resistor will have more than half of the voltage applied across resistor 31 and therefore no other resistor will switch into an energized state if the voltage applied between terminals 21 and 30 is just above the threshold voltage.

If the resistors used in thermal printer head 20 had a normal resistor voltage-current characteristic, the current drain on power supply 14 would be enormous since all the resistors are interconnected and each would draw a substantial current. Many undesired resistors would dissipate a substantial amount of power and cause marks on the thermally sensitive paper. The individual resistor heater elements were interconnected to prevent an excessive number of printer head leads outs from being required and also to reduce the combined total number of switching positions required in selector switches 12 and 13.

The ratio of the voltage applied across a desired resistor to the largest voltage across an undesired resistor is always greater than one for any printer head array which is connected in the same manner as the array shown in FIG. 2 and consists of any number of dot and group selector terminals and a corresponding number of resistors. For an array consisting of 80 resistors, 20 dot selector terminals and 4 group selector terminals, a ratio of 23 to 19 is obtained. An array consisting of 80 resistors, 10 dot selector terminals, and 8 group selector terminals has a ratio of 17 to 7. It is clear to one skilled in the art that as the ratio gets larger, looser tolerance resistors having voltage-current switching characteristics with a less stable and less pronounced threshold voltage transition can be used.

Figure 6:
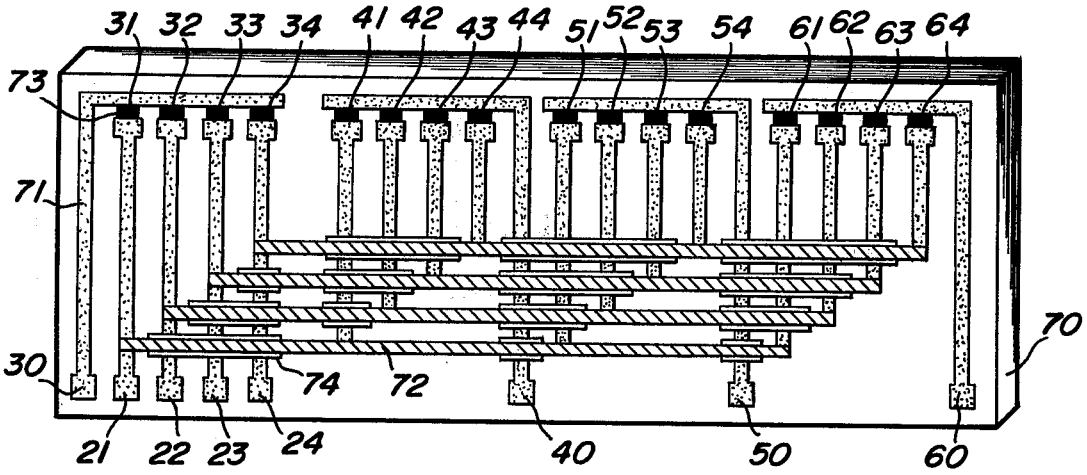
FIG. 6 is a pictorial representation of an embodiment of a thermal printer head according to the invention.

FIG. 6 shows a pictorial diagram of a preferred thick film circuit representing the thermal printer head 20 shown schematically in FIG. 2. An insulating substrate 70 is shown in FIG. 6 as the base substrate for a first conductor metalization 71 (shown stippled), a second conductor metalization 72 (shown cross-hatched), a first resistor metalization 73 (shown shaded), and an isolation metalization 74 (shown clear). The metalizations form the components and connections drawn schematically in FIG. 2. Dot selector terminals 21–24 and group selector terminals 30, 40, 50 and 60 are shown as first conductor metalization-pads in FIG. 6, individual resistor heater elements are 31–34, 41–44, 51–54 and 61–64 are shown as thick film resistors in FIG. 6, and all components shown in FIG. 6 are numbered identically to their respective components shown in FIG. 2. The preferred insulating material for substrate 70 is 96% alumina. Metalizations 71, 72, 73 and 74 in FIG. 6 are preferably deposited and processed by using thick film screening and firing techniques. Desired isolation between crossovers of conductor metalization layers 71 and 72 is accomplished by using a screened dielectric insulator as the intermediate isolation metalization 74 and a screened top metalization conductor as second conductor metalization 72. All these processes are common to thick film technology. The resistor array illustrated in FIG. 6 shows the individual resistors forming a row of discrete dots. However, the invention is not limited to such an array and can be used in a much more complex arrangement of resistor heater elements.

While numerous improvements on the concepts disclosed herein will be obvious to persons skilled in the art, all such improvements which retain the basic underlying concepts are within the scope of the invention.

I claim:

1. A thermal printing system comprising:

thermal printer head means;

a plurality of voltage-current switching characteristic resistors attached to said printer head means, each of said resistors having a threshold voltage;

a plurality of first selector terminals;

a plurality of second selector terminals;

first means for connecting each of said first terminals through a different path to each of said second terminals, each path having at least one of said plurality of resistors and including only different resistors of said plurality of resistors; and second means for applying voltages greater than said threshold voltage between said first and second terminals for energizing only selected predetermined individual resistors in said plurality of resistors by causing only the voltages across these selected resistors to exceed the threshold voltage of these resistors.

2. The thermal printer system of claim 1 wherein the thermal printer head means includes:

an insulating substrate means; and metalizations, including conductor and resistor metalizations, attached directly to said substrate means and forming said plurality of voltage-current switching characteristic resistors.

3. The thermal printing system of claim 2 wherein all individual resistors in said plurality of resistors are approximately equal in resistance value.

4. The thermal printer system of claim 3 wherein said metalizations attached to said thermal printer head means include a dielectric insulating metalization.

5. The thermal printer system of claim 4 wherein said conductor metalizations on said printer head means form said plurality of first selector terminals and said plurality of second selector terminals.

6. The thermal printer system of claim 5 wherein the said metalizations on said substrate means are screened on thick film metalizations.

7. The thermal printer system of claim 6 wherein the said substrate means is an alumina substrate.

8. The thermal printer system of claim 7 wherein said plurality of resistors are arranged in a straight line array.

9. The thermal printer system of claim 8 wherein said plurality of resistors consists of 16 resistors, said plurality of first selector terminals consists of 4 terminals, and said plurality of second selector terminals consists of 4 terminals.

10. A thermal printer head comprising:

base means;

a plurality of voltage-current switching characteristic resistors attached to said base means, each of said resistors having a polarity independent threshold voltage;

a plurality of first selector terminals attached to said base means;

a plurality of second selector terminals attached to said base means; and means for connecting each of said first terminals through a different path to each of said second terminals, each path having at least one of said plurality of resistors and including only different resistors of said plurality of resistors.

11. The thermal printer head of claim 10 wherein said base means is an alumina substrate.

12. The thermal printer head of claim 11 wherein said plurality of resistors are created by metalizations, including conductor and resistor metalizations, attached to said substrate.

13. The thermal printer head of claim 12 wherein said pluralities of first and second selector terminals are formed by said conductor metalizations.

14. The thermal printer head of claim 13 wherein said metalizations include a dielectric metalization layer and each resistor of said plurality of resistors is located in a straight line on said substrate.

15. A method for generating heat from selected individual resistor elements including the steps of:

interconnecting each of a plurality of first terminals through a different path to each of a plurality of second terminals, each path having at least one of a plurality of resistors and including only different resistors of said plurality of resistors, each of said resistors having a threshold voltage-current switching characteristic;

applying, selectively, voltages above the threshold voltage of the individual resistors between one of said first and one of said second terminals to generate heat from only selected individual resistors by causing only the voltages across the selected resistors to exceed the threshold voltage of the selected resistors. of;

16. The method described in claim 15 wherein the method includes the step of;

coupling thermally sensitive paper to said individual resistors to create marks corresponding to individual resistors that have been selected to generate heat.

17. The method of claim 16 wherein voltage is applied between only one of said first terminals and one of said second terminals at any one time.

* * * * *